US005199768A

United States Patent [19]

Tripolko et al.

[11] Patent Number: 5,199,768

[45] Date of Patent: Apr. 6, 1993

[54] METHOD FOR DEVELOPING THICK BEDS OF MINERALS

[76] Inventors: Alexandr S. Tripolko, ulitsa Jubileinaya, 86, kv. 90; Vasily L. Klishev, prospekt Lenina, 8, kv. 40.; Vladimir Y. Kovtun, ulitsa Bljukhera, 3, kv. 6.; Lev M. Papulov, ulitsa Kalinina, 26, kv. 7., all of Berezniki, Permskaya oblast, U.S.S.R.

[21] Appl. No.: 733,626

[22] Filed: Jul. 19, 1991

[51] Int. Cl.[5] ..... F21C 41/00

[52] U.S. Cl. ..... 299/18; 299/19

[58] Field of Search ..... 299/10, 18, 19

[56] References Cited

FOREIGN PATENT DOCUMENTS

| | | | |
|---|---|---|---|
| 2705985 | 8/1978 | Fed. Rep. of Germany | 299/19 |
| 1011861A | 4/1983 | U.S.S.R. . | |
| 1418472 | 8/1988 | U.S.S.R. | 299/18 |

OTHER PUBLICATIONS

Processes of Underground Mining in Development of Ore Deposits, NEDRA Publishers, 1984, Moscow, pp. 434–439.

*Primary Examiner*—David J. Bagnell
*Attorney, Agent, or Firm*—Beveridge, DeGrandi, Weilacher & Young

[57] ABSTRACT

A method for developing thick beds of minerals accomplished by large-section rooms. The method comprising the preparation of the room for winning which includes providing a conveyor working below the soil of the room and extending for the entire length thereof, driving transport and fan drifts and raises, and forming an inclined working to fit the design contour of the room. The winning is effected in horizontal layers in a descending order by forward and reverse movements of the cutter-loader. Each horizontal layer is developed by stopes throughout the entire length of the room via overlapping the cutter-loader movements. The first stope in each layer is developed in the range of the raises. Subsequent stopes are formed adjacent one another outwardly in the direction from the first stope toward the edges of the room. Extraction of subsequent layers starts from the soil of the preceding layer by deepening the cutter-loader to a layer underneath to the height of its actuator. In the end part of the room within the limits of one stope there is formed an inclined descent to a layer below which is then suppressed while developing this layer opened by this descent. The inclined working is opened in each layer by developing extreme movement in the steps from the raise outward to the inclined working. The mineral is supplied to the raises and passed to the conveyer working.

6 Claims, 2 Drawing Sheets

METHOD FOR DEVELOPING THICK BEDS OF MINERALS

The invention relates to the mining industry and, more specifically, to a method for developing thick beds of minerals.

FIELD OF THE INVENTION

The invention can be used to advantage in developing salt deposits using cutter-loads, as well as in the building of special-purpose underground large-section rooms.

BACKGROUND OF THE INVENTION

Known in the art is a method for upward development of thick beds of horizontal layers with filling of developed space (V. R. Imenitov, Processes of Underground Mining in Development of Ore Deposits, Nedra Publishers, 1984, Moscow, pp. 434–439). Accomplishment of the known method calls for using a hardening filling because a successive layer is extracted from a previously laid layer along which self-propelled face equipment moves. In order to maintain using self-propelled equipment, inclines extend between transport and fan drifts in the inter-room pillars giving access to haul cycles in each layer. Free space 3.5 m high is left between ore mass and the laid layer. Individual layers of the same thickness of a bed are processed by way of explosive drilling.

The known method fails to provide intensive treatment for the individual extraction of a mineral, because the process cycle provides for alternating processes of extraction and laying which are incompatible in time and space. In addition, the known method calls for driving from the transport inclines of the drives to each layer, thus appreciably increasing the volume of preparatory work.

Known in the art is a method of developing thick beds (SU,A,1011861) comprising the preparation of the room for winning and the winning proper. Preparation of the room for winning consists of conveyer working and the installation of a conveyer therein, cropping of the room neck, and driving of the transport and fans drifts.

Winning is effected in layers from top to bottom. The room is developed in two layers. First, the layers are developed from top to bottom, i.e., in a descending order, in one part of the room with the formation of a temporary inclined descent along the entire width of the room and its entire height. Thereupon, using this inclined descent in layers from top to bottom, the second part of the room is developed. The inclined descent is formed due to the fact that each layer underneath is developed shorter than the preceding one to a length that ensures the formation of a safe angle of descent for self-propelled vehicles.

Development of the first layer comprises consecutive extraction of a number of stopes as to the width of the room with the application of the cutting machine runnings. The development of the second and subsequent layers also resides in consecutive extraction of stopes relative to the room width, but with the application of the machine runnings not only relative to the room width, but also the room height.

Development of each layer begins with extracting the first stope adjacent to the room edge with the formation of blind drive-ins, opening the raises and permitting switching and unloading of the means of haulage.

At the end of the first stope the cutter-loader is turned through 180° and using a reverse motion the second adjacent stope is extracted. Once the second stope is extracted, the machine is again turned through 180° to start extracting the third stope adjacent to the second and so on and so forth. Following the development of one layer, the cutter-loader, moving along the slope downwards, gets deeper into the second layer, thereupon, the first stope of the second layer is extracted. Then, the rest of the stopes of this layer are developed, whereupon, using the formed part of the temporary inclined descent, the machine is deepened to a third layer and so work goes on until the soil of the room is removed.

The remaining part of the room reserves is developed at the second stage in an analogous manner to be used for cutting the temporary descent layer.

The known method is characterized by a low efficiency in the use of machine complexes and fails to provide a high level of operation safety at the second stage for the following reasons:

1. Development of room reserves in two stages with the formation of a temporary inclined descent across the entire width of the room and final development of the remaining part of the room reserves from this inclined descent makes it necessary for the machine to operate in each layer and each stope (in the zone of inclined descent) by incomplete section of the actuator (the machine technical possibilities are not efficiently used). This method also requires the running of machine complexes with stopes of variable length. In so doing, for each type of equipment, an optimal length of delivery is predetermined (length of the room of stope), whereby the cutter-loader does not stay idle awaiting the arrival of transporting means.

Meanwhile, as the inclined descent is formed at the first stage and in the beginning of each layer at the second stage, the machine in each stope operates with an incomplete usage of the actuator section to section to cause a decline in the machine output and additional dynamic loads on the machine impairing its reliability and service life.

2. Extraction of the first stope in each layer near the room edge involves the formation of blind drive-ins to the raises along the entire length of the room requires additional driving and operation of blind curvalinear drive-ins in each layer.

The operation of cutter-loaders in curvalinear sections reduces their output and takes more time for survey control over the direction when driving these drive-ins. In so doing, the formation of blind drive-ins characteristics of the known method appreciably complicates self-propelled vehicles' maneuvers, calls for additional time for their U-turns in drive-ins, which doubtless affects the output of complexes and call for using a large number of machines and service personnel. Also, the presence of these drive-ins rules out the possibility of using a continuous means of delivery.

3. Conveyer working along the soil of the lower layer while preparing the room for winning creates additional complexities for full development of the two lower layers of the room by complexes of machines. This is so because it is not ruled out that a machine can fall through to this heading on a delivery conveyor.

4. Preparation of the room neck, as it gets ready for winning operations, presupposes using different types of equipment and the technique of explosive-drilling extraction during the neck preparation and the extraction by machine—during winning operations.

5. Suppression, which is characteristic of the known method in the inclined descent formed along the entire width and height of the room at the first stage of winning, deprives the room of communication with a fan drift and simple and reliable safety escapes, because consecutive downward suppression by layers of the inclined descent at the second stages will remove the layer being worked from the fan drift, and communication with it will be fairly difficult or impossible in general.

BRIEF DESCRIPTION OF THE INVENTION

It is an object of the invention to provide a method for developing thick beds o minerals permitting the providing of a straight-line continuous automatic process of extracting a mineral ensuring a higher output of the complex machines and safety of mining.

The invention essentially resides in a method of developing thick beds of minerals accomplished by large-section rooms. During preparation of a room for winning, the conveyer working is driven to the entire length of the room along its axis. Also, the transport and fan drifts are driven along with raises extending from the conveyer working up to the room roof. The winning of a mineral in the room is effected by a machine and in horizontal layers arranged in a descending order. Each of the layers is developed by stopes overlapping the passes alternately with a forward and reverse motion of the machine. In so doing, extraction of each subsequent layer starts from the soil of a preceding one by a deepening of the machine to a layer lying below to the height of the machine actuator with the formation of an inclined descent and subsequent suppression thereof. The mineral is delivered to the raises through which it is passed to the working conveyer below. According to the invention, prior to the onset of winning relative to the design contour of the room between the transport and fan drives, an inclined working is driven and is consecutively opened by the development in each layer of an extreme motion. The conveyer drift extends beneath the soil of the room. The stopes in each layer are developed throughout the whole length of the room and, in so doing, the first stope in each layer is developed in the range of raises, and subsequent stopes in the layer are developed in the direction of the first stope toward the edges of the room. The inclined descent is formed in the end portion of the room within the range of one stope to a layer below, and it is suppressed when developing the layer opened by this descent.

The invention as claimed helps increase the output of cutter-loader complexes and the safety of performing mining operations. These advantages of the present invention are due to the driving of a conveyer working below the room soil and the driving, prior to winning, of an additional inclined working to fit the room contour between the transport and fan drifts. Also, the aforementioned advantages are achieved by the development of reserves in each layer by forward and reverse motion throughout the entire length and width of the room, opening the inclined working by extreme motions in each layer (the last being at the room's edge) and the extraction of the following layer with the formation of the first stope thereupon of an inclined descent. The inclined descent is formed in the end part of the room within the limits of the width of one motion only to the height of one layer and as a continuation of the driving (extraction) of the first stope therefrom in the range of raises. The advantageous method of the present invention also includes the suppression of the descent formed during development of the layer opened by this descent.

The invention as claimed allows the output of cutter-loader complexes to be increased due to a more effective use of the sectional area of the cutter-load loader actuator, a minimization of cutter-loader operation, incomplete usage of a cutter-loader's actuator, and dynamic loads of the machine. The invention also provides for streamlining the transportation scheme of broken down ore within each layer, operation of delivery means at the constant and optimal length of delivery, utilization of only one type of equipment during winning and preparatory work, the possibility of controlling the complex in an automatic mode according to a prescribed program owing to all constant technological parameters and strict sequence of the execution of operations in each layer. The safety of mining operations is enhance due to a reliable connection of the layers developed to the basic and auxiliary workings, and the providing of a constant link between each layer with the transport and fan drifts for the whole period of room development.

BRIEF DESCRIPTION OF THE DRAWINGS

The invention as claimed will become more apparent by the description of a specific exemplary embodiment thereof and the accompanying drawings, wherein:

DETAILED DESCRIPTION OF THE INVENTION

The method of developing thick beds of minerals is accomplished as follows.

Figure 1:
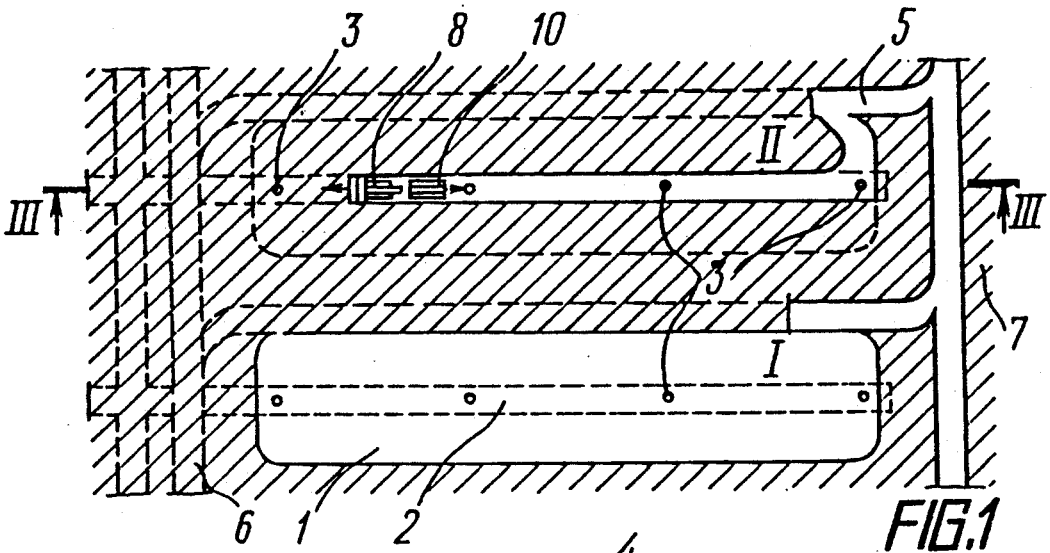
FIG. 1 shows a view in plan of the preparation and extraction of the first stope in the first layer, according to the invention.

The preparation or room 1 (FIG. 1) for winning consists of providing conveyer working 2 below the soil of the room 1. The conveyer extends along the room's axis for the entire length of the room 1. Raises 3 extend from the conveyer to the roof of room 1 FIG. 1 further illustrates the driving of the inclined transport working 5 relative to the design contour of the room 1 at one of its edges between the transport and fan drifts 6 and 7, respectively.

Winning in the room 1 is carried out in one stage by horizontal layers starting from top with horizontal and vertical application of the movement of a cutter-loader 8.

Development of the first layer begins with a stope that begins at the inclined working 5 (FIG. 1) and extends until opening the raise 3 in the end part of the room 1. Thereupon, the cutter-loader 8 turns 90° and extraction of the first stope is continued in the range of the rest of raise 3, opening the latter as the face is advanced. Upon opening the last raise 3 in the end of room 1, the cutter-loader 8 turns 180° and during reverse motion the second stope is extracted adjacent to the first from the other side. The third stope adjacent to the first from the other side is developed by forward motion. Subsequent stopes are also developed by the cutter-loader's forward and reverse motion toward the edges of the room 1 (FIG. 5), i.e., movement of the face during extraction of the layer takes place when the machine moves forward and backward.

Figure 2:
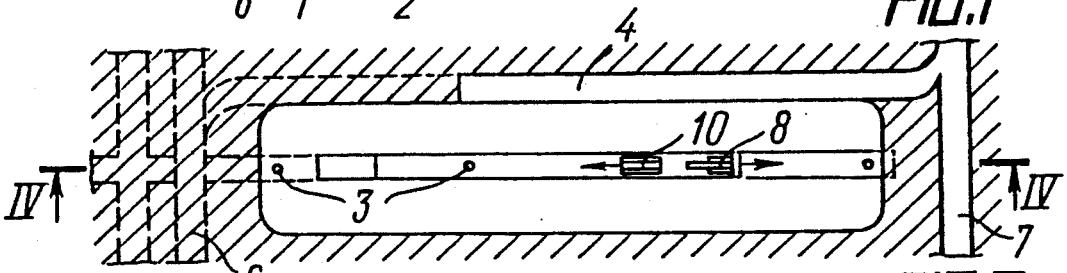
FIG. 2 is a view in plan of the opening of a subsequent layer by the inclined descent.
Figure 3:
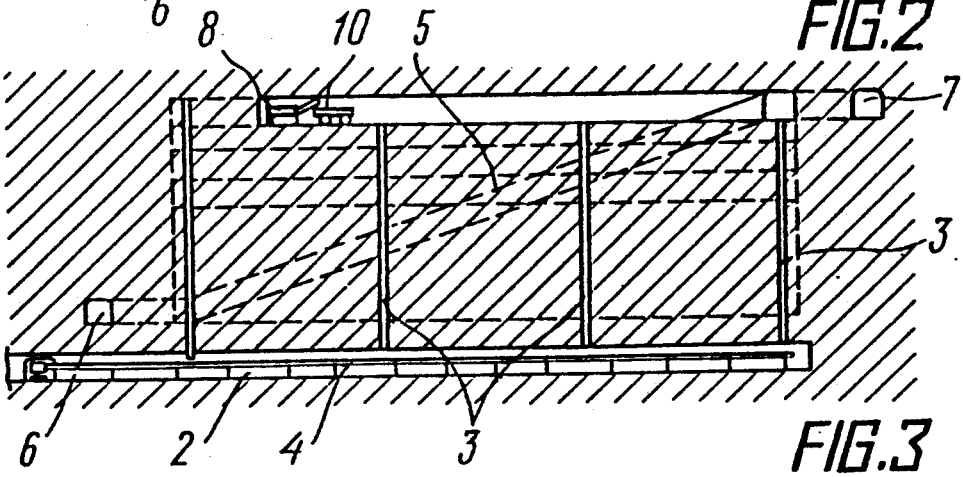
FIG. 3 is a cross-section taken along III—III of FIG. 1 showing the preparation and the first stope in the first layer.
Figure 4:
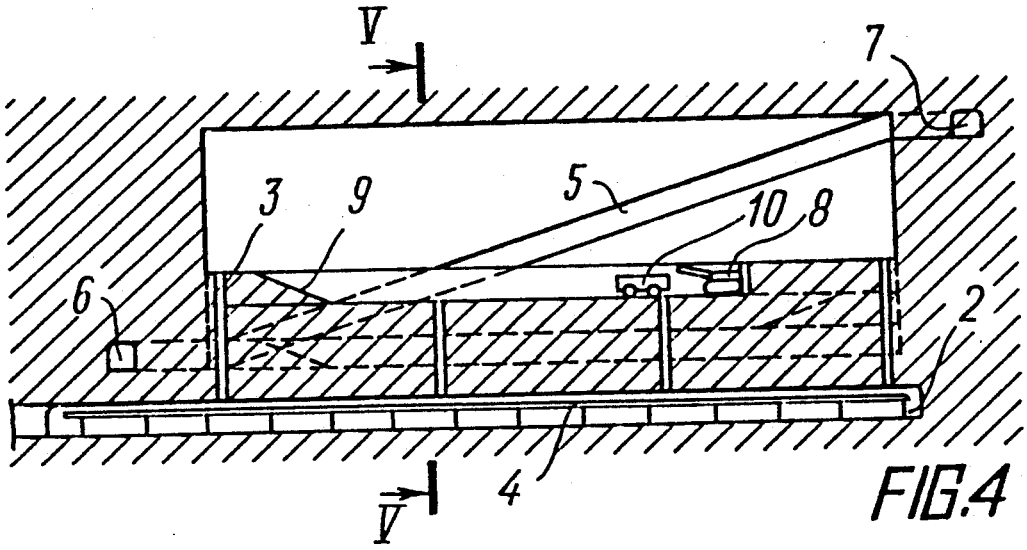
FIG. 4 is a cross-section taken along IV—IV of FIG. 2 of the same with an inclined descent to the subsequent layer.
Figure 5:
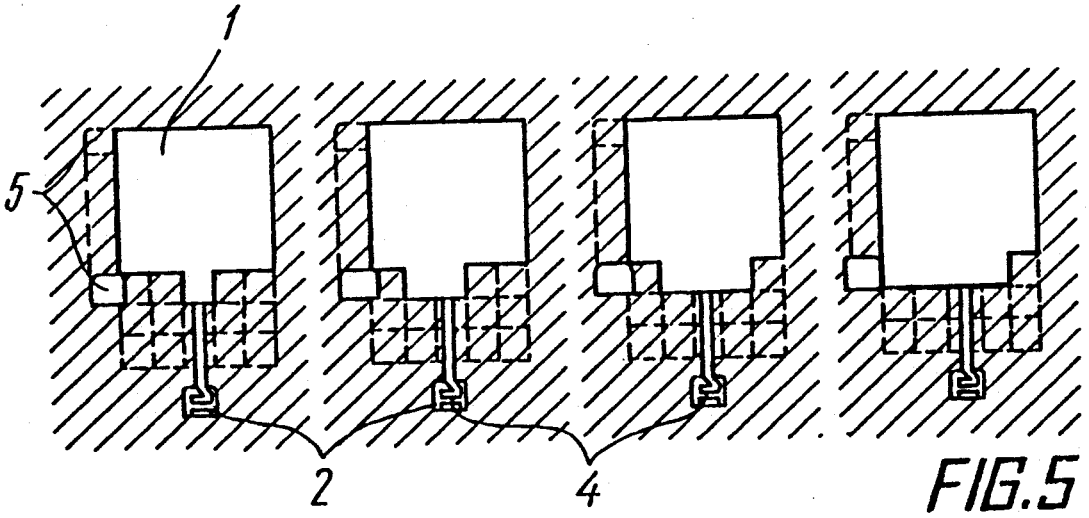
FIG. 5 is a cross-section taken along V—V of FIG. 4 of the sequence in the extraction of stopes in a layer.

The second and each subsequent layer starts from the soil of the room 1 of the first or preceding layer by deepening the cutter-loader 8 to a layer underneath to the height of its actuator also in the range of the raises 3 (FIG. 2). A temporary descent 9 (FIG. 4) is formed which is suppressed when extracting the opened layer adjacent temporary descent layer 9. The inclined transport working 5 is opened in each layer while extracting the stope at the edge of the room 1 (FIG. 5).

As stopes are extracted in each layer by the cutter-loader 8, a mineral is delivered by a self-propelled transport means 10 to the nearest raise 3 and, under action of its own weight, the mineral is taken to the conveyer working 2, along which it is transported by the conveyer 4 further to a panel conveyer (not shown in the drawing). The distance between the raises 3 is taken equal to the optimal one by the length of delivery for a specific composition of the cutter-loader complex.

The equipment and people are brought to each layer, and the cutter-loader complex is energized, through use of the inclined transport working 5 passing between the transport and fan drifts 6 and 7, respectively. The inclined transport working 5 is designed to fit the design contour of the room 1, at an angle of inclination overcome by the self-propelled transport means 10. The room 1 is aired by feeding a fresh jet from the transport drift 6 via the raises 3 and further downward the inclined transport working 5 to the fan drift 7.

Thus, driving of the inclined transport working 5 (FIG. 1) to fit the design contour of the room 1 and the opening thereof by extreme stopes ensures the availability of a simple and reliable stand-by exit from each layer for the entire period of development thus enhancing mining safety. The arrangement of the inclined transport working makes it possible to rule out the necessity of driving the stopes to each layer, thereby reducing the volume of preparatory works.

Arrangement of the conveyer working 2 below the soil of the room 1 and along its axis helps to prevent difficulties associated with the development of the two last lower layers.

A single-stage downward extraction of the reserves in the room 1 by layers enables one to rule out non-productive operations related to the movement of the complex from the lower part of the room 1 upon completion of the first stage to the top part of the room 1 for the beginning of the second stage.

Formation of the inclined descent 9 across the width of one (first) stope minimizes the volume of the cutter-loader 8 operation with an incomplete cross-section of its actuator and avoids dynamic loads upon the machine.

Development of the first stope in each layer in the range of raises 3 makes it unnecessary to drive blind curvalinear drive-ins to open each raise 3 and associated therewith additional time for mine surveying, complex maneuvering and movement of self-propelled transport means 10.

Sequence in the development of stopes in each layer in the direction from the raises 3 opened by the first movement towards the edges of the room 1 alternately by the forward and reverse motions of the cutter-loader provides enhanced conditions for the flow technology of mineral extraction, automation of machine operation within each layer, and simple transport links with any ore chutes.

Sequence in the execution of preparatory and winning operations in the room 1 permits using a single type equipment for these operations.

In general, the present invention's introduction of operations such as the driving of the inclined transport working 5 to fit the design contour of the room 1 and the driving the conveyer working 2 below the soil of the room 1 together with the, per se, prior art process elements (downward development of the reserves of the room 1 by layers, development of each layer by stopes using the raises 3 for ore passage which are disposed at an optimal distance for delivery), when performed in an accepted sequence, make it possible to provide a flow technology to extract minerals which raises the output of the cutter-loader complex and improves the safety of mining.

We claim:

1. A method for developing a thick bed of minerals, comprising the following operations:

preparing a room with a contour for winning which includes;

incorporating a working conveyor below soil of the room which working conveyor extends lengthwise a long a length of the room, forming transport and fan drifts in the thick bed, forming raises extending from the working conveyor to a roof portion of the room, forming an inclined working between the transport and fan drifts so as to fit the contour of the room;

winning of a mineral, said winning being carried out in the room in horizontal layers downward by forward and reverse movements of a cutter-loader;

developing each of said horizontal layers through stopes extending along the length of the room through the forward and reverse movement of the cutter-loader, a first stope in each horizontal layer being developed in range of said raises, and subsequent stopes in each layer being developed in a direction from the first stope outward to an edge of the room;

extracting each subsequent horizontal layer beginning with soil of the preceding horizontal layer by a deepening of the cutter-loader to a layer underneath, the extracting including forming an inclined descent at an end part of the room and suppressing said inclined descent when developing the horizontal layer opened by said inclined descent, the extracting further including opening said inclined working to the horizontal layers by developing an extreme movement of said cutter-loader in each horizontal layer, supplying mineral to said raises and the passing of mineral through the raises to said working conveyor.

2. A method as recited in claim 1, wherein incorporating a working conveyor includes extending said conveyor for the full length of said room in line with a plurality of spaced raises.

3. A method as recited in claim 1, wherein the forward and reverse movement of said cutter-loader is for the full length of said room between a forward and a rearward end of said room.

4. A method as recited in claim 3, wherein said forward and rearward movement of said cutter-loader includes reorientating said cutter-loader at the forward and rearward end of said room so at to achieve an alternating overlapping motion in said cutter-loader wherein direct access to said raises is maintained.

5. A method as recited in claim 3, wherein said inclined working extends along an edge of said room and between the forward and rearward end of said room.

6. A method as recited in claim 1, wherein said descent is formed so as to have a width equal to that of said first stope.

* * * * *